United States Patent [19]

Langenfeld et al.

[11] Patent Number: 4,601,634

[45] Date of Patent: Jul. 22, 1986

[54] CYLINDER STRAIN RELIEF LINKAGE FOR A LOADER DEVICE FOR A TRACTOR OR THE LIKE

[75] Inventors: Joseph W. Langenfeld; Neal W. Westendorf, both of Onawa, Iowa

[73] Assignee: Westendorf Manufacturing Company, Inc., Onawa, Iowa

[21] Appl. No.: 773,014

[22] Filed: Sep. 6, 1985

[51] Int. Cl.[4] ..... E02F 3/36

[52] U.S. Cl. ..... 414/697; 414/917

[58] Field of Search ..... 414/685, 686, 697, 706, 414/707, 708, 710–713, 715, 723, 917

[56] References Cited

U.S. PATENT DOCUMENTS

| | | | |
|---|---|---|---|
| Re. 24,746 | 12/1959 | Pilch | 414/713 |
| 2,678,741 | 5/1954 | Pilch | 414/697 X |
| 4,381,167 | 4/1983 | Baty | 414/697 |

*Primary Examiner*—Robert J. Spar
*Assistant Examiner*—Donald W. Underwood
*Attorney, Agent, or Firm*—Zarley, McKee, Thomte, Voorhees & Sease

[57] ABSTRACT

A loader device for a tractor or the like comprising a frame which is adapted to be removably secured to the tractor or the like and which includes first and second uprights with the upper ends thereof being spaced laterally outwardly from the lower ends. Boom arms are secured to the uprights and extend forwardly therefrom. Hydraulic cylinders are pivotally connected to the lower ends of the uprights and to the boom arms for raising and lowering the boom arms relative to the uprights. Hydraulic cylinders are connected to the upper ends of the boom arms and extend forwardly therefrom outwardly of the boom arms. A linkage pivotally connects the lower ends of the second pair of hydraulic cylinders and a loader bucket is pivotally mounted on the forward ends of the boom arms. The linkage connecting the second pair of hydraulic cylinders is positioned outwardly of the boom arms.

5 Claims, 5 Drawing Figures

CYLINDER STRAIN RELIEF LINKAGE FOR A LOADER DEVICE FOR A TRACTOR OR THE LIKE

BACKGROUND OF THE INVENTION

This invention relates to a loader device and more particularly to loader device which includes a cylinder strain relief linkage.

Conventional tractor loaders normally include a pair of boom arms which extend forwardly from a pair of towers or uprights mounted on the tractor and which have a loader bucket or some other materials handling implement mounted on the forward end thereof. The conventional tractor loaders normally include a pair of lift cylinder which are secured at their rearward ends to the uprights and secured at their forward ends to the underside of the boom arms. The conventional loaders also include bucket cylinders which are usually positioned on the upper portion of the forward ends of the boom arms and connected to the bucket for pivotally moving the bucket between dumping and tipped-back positions.

The positioning of the hydraulic cylinders and the pivotal connection of the hydraulic cylinders on the conventional loaders interferes with the visibility of the operator. Further, the normal positioning of the bucket cylinders limits the amount of pivotal movement of the loader bucket relative to the boom arms. Additionally, the conventional means for connecting bucket cylinders to the loader bucket creates severe strain on the bucket cylinders.

Therefore, it is a principal object of the invention to provide an improved loader device for a tractor or the like.

A further object of the invention is to provide a loader device which reduces the amount of strain normally applied to the bucket cylinders.

A further object of the invention is to provide a loader device for a tractor or the like having improved visibility.

A further object of the invention is to provide a loader device for a tractor or the like wherein the bucket cylinders are positioned outwardly of the boom arms.

Still another object of the invention is to provide a loader device for a tractor or the like wherein the lift cylinders are positioned inwardly of the boom arms.

Yet another object of the invention is to provide a loader device for a tractor or the like which provides more power to the bucket.

These and other objects will be apparent to those skilled in the art.

BRIEF DESCRIPTION OF THE DRAWINGS

FIG. 1 is a rear perspective view of the loader device mounted on a tractor or the like:

SUMMARY OF THE INVENTION

A loader device is described herein which is ideally suited for mounting on a tractor or the like. In addition to conventional tractors, the loader device may be mounted on large industrial equipment as well. The loader device includes a pair of uprights or towers which are mounted on the tractor with the upper ends of the uprights being spaced laterally outwardly of the lower ends thereof. A pair of boom arms are pivotally secured to the uprights below the upper ends thereof and extend forwardly therefrom. Lift cylinders are pivotally connected to the lower ends of the uprights and extend forwardly therefrom inwardly of the inner sides of the boom arm. The forward ends of the lift cylinders are connected to the boom arms. A loader bucket or other materials handling implement is pivotally mounted on the forward ends of the boom arms. Bucket cylinders are pivotally connected at their rearward ends to the upper ends of the uprights and extend forwardly therefrom outwardly of the outer sides of the boom arms. A linkage means pivotally connects the forward ends of the bucket cylinders, the boom arms and the loader bucket to enable the loader bucket to be moved between dumping and tipped-back positions. The relationship of each of the linkage means results in more power being applied to the bucket, improves operator visibility while reducing the amount of strain normally applied to the bucket cylinders. Additionally, the configuration of the linkage means enables the loader bucket to have greater tipped-back and dumped positions.

DESCRIPTION OF THE PREFERRED EMBODIMENT

Figure 1:
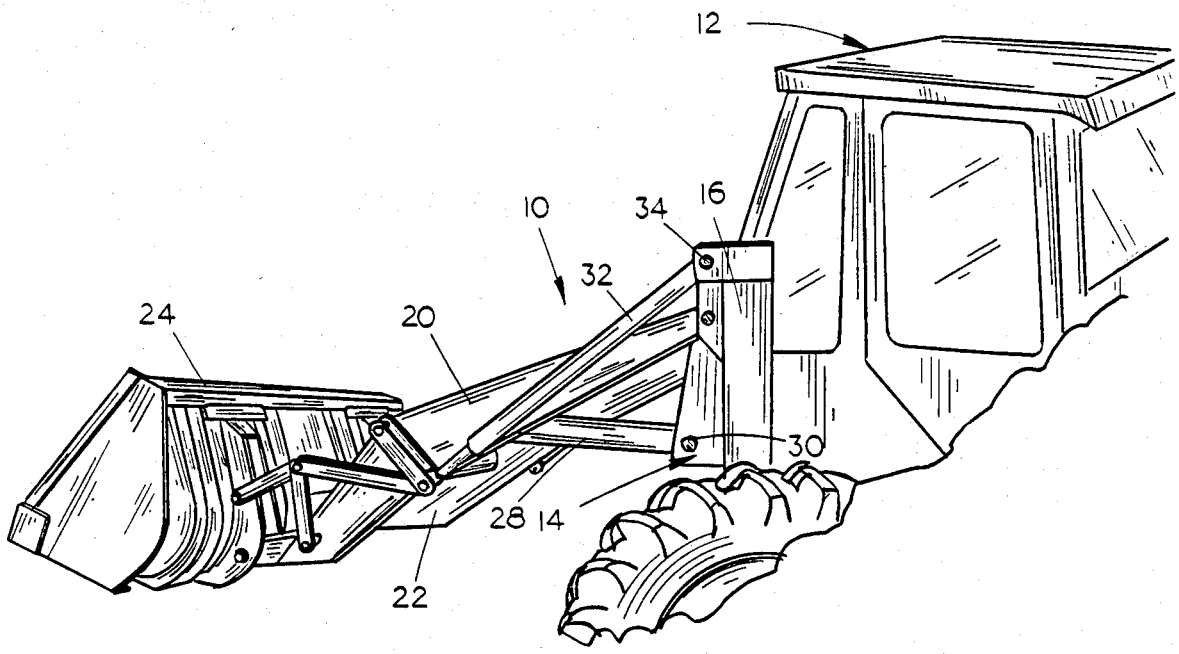
Figure 2:
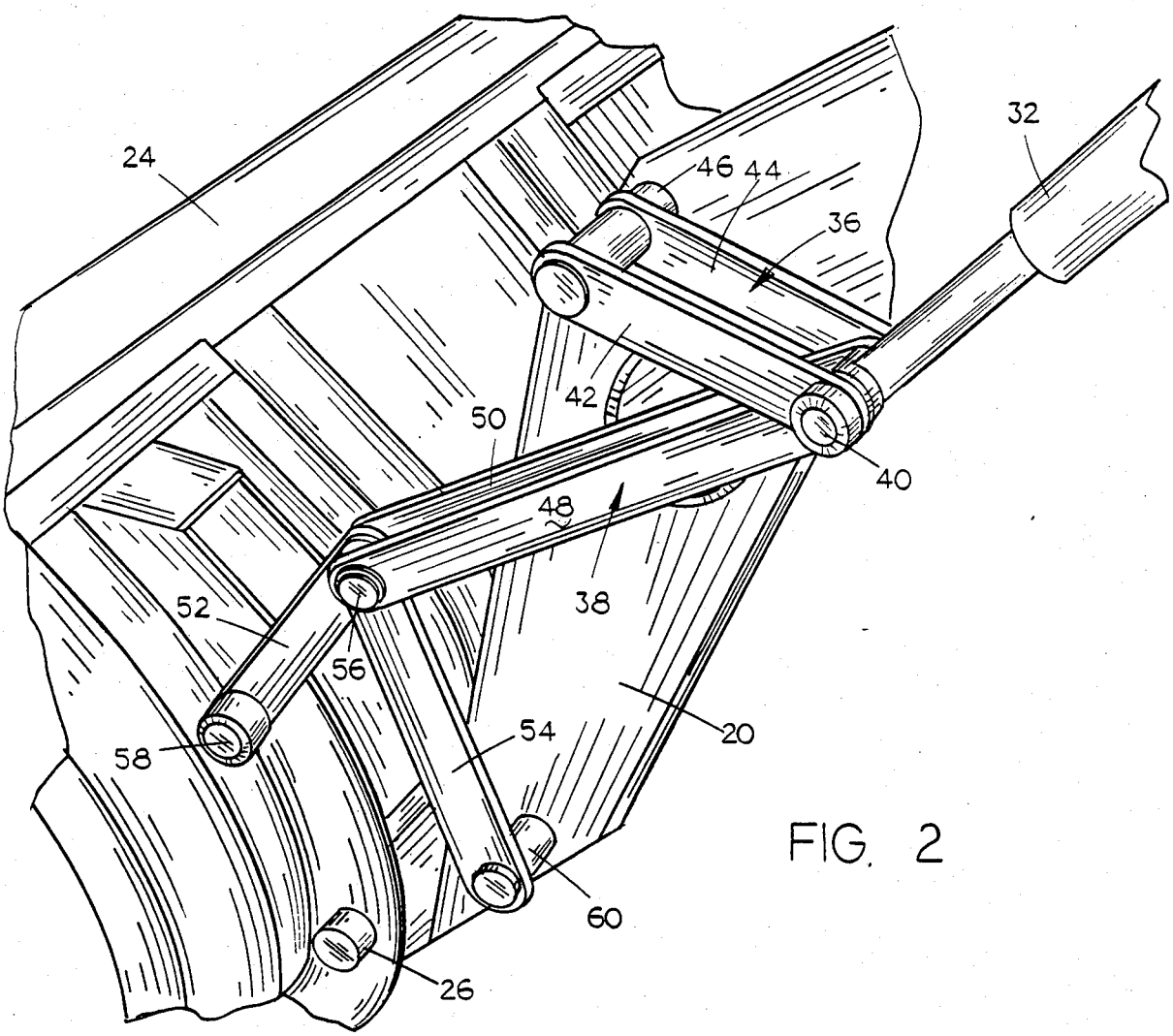
FIG. 2 is a rear perspective view illustrating the linkage which connects one of the bucket cylinders, one of the boom arms and the loader bucket.
Figure 3:
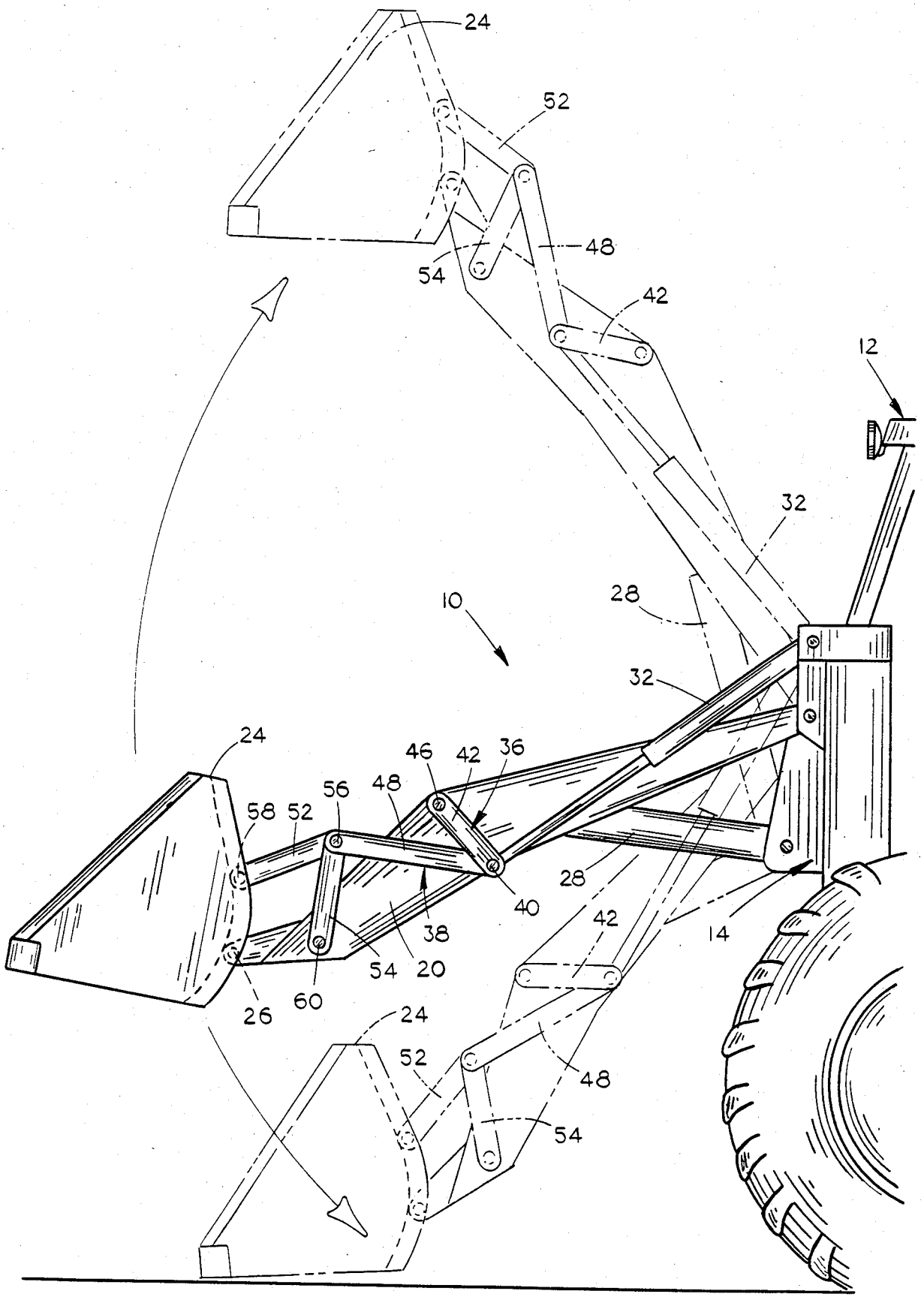
FIG. 3 is a side view of the loader device with the broken lines indicating positions to which the loader device may be moved.
Figure 4:
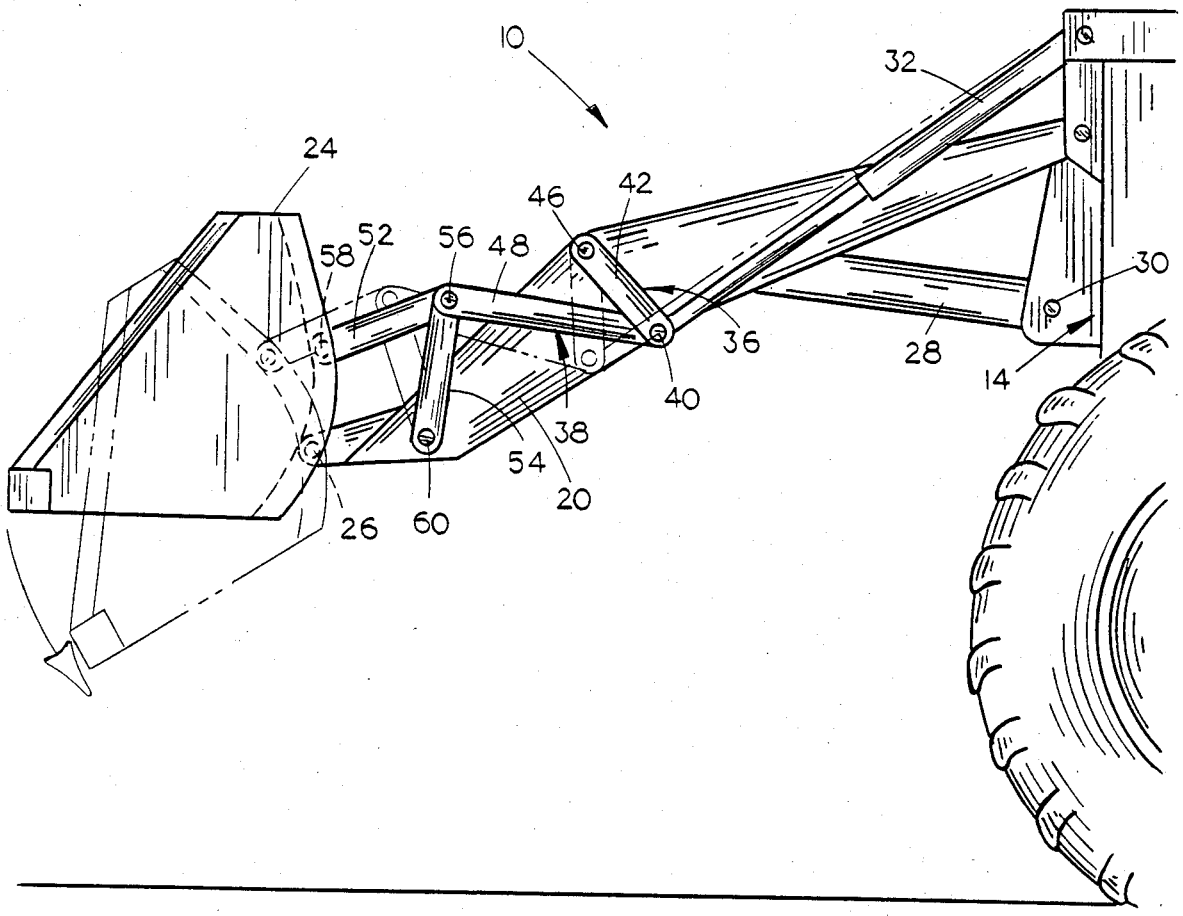
FIG 4 is a side view of the loader device with the broken lines indicating the manner in which the bucket may be pivoted downwardly.

The loader device of this invention is referred to generally by the reference numeral 10 which is designed to be mounted on a conventional tractor 12 or other type of industrial equipment. The loader device 10 normally would include a frame means 14 which would be of the "quick-attach" type to enable the loader device to be quickly and easily mounted on the tractor 12 or removed therefrom. The frame means 12 includes a pair of uprights or towers 16 and 18 (not shown). Each of the uprights 16 and 18 is designed so that the upper ends thereof are positioned laterally outwardly of the lower ends thereof. A pair of boom arms 20 and 22 are pivotally connected to the uprights 16 and 18 below the upper ends thereof as illustrated in the drawings. A loader bucket 24 is pivotally mounted on the forward ends of the boom arms 20 and 22 as seen in the drawings. For example, FIG. 2 illustrates boom arm 20 being pivotally connected to the bucket 24 by means of pin 26.

Lift cylinder 28 is pivotally connected at its rearward end to the lower end of upright 16 at 30 and extends forwardly therefrom inwardly of boom arm 20. The forward end of lift cylinder 28 is pivotally connected to boom arm 20 adjacent the inner side thereof. A lift arm identical to boom arm 28 is also pivotally connected to and extends between the upright 18 and the boom arm 22.

Bucket cylinder 32 is pivotally connected at its rearward end to the upper end of upright 16 at 34 and extends forwardly therefrom outwardly of the outer side of boom arm 20. The forward end of bucket cylinder 32 is pivotally connected to a first link means 36 and a second link means 38 by means of pin 40. Link means 36 includes links 42 and 44 which are pivotally secured to pivot pin 46 which extends horizontally outwardly from boom arm 20 as illustrated in FIG. 2. Link means 38 is comprised of links 48 and 50 which are pivotally connected to third and fourth link means 52 and 54 by means of pin 56. Link means 52 is pivotally connected to the rearward end of the bucket 24 by means of pin 58. The lower end of link means 54 is pivotally connected to a pivot pin 60 which extends laterally outwardly from boom arm 20. The loader device of this invention is provided with a bucket cylinder identical to cylinder 32 but which is mounted on the upright 18. The bucket cylinder connected to the upright 18 is also connected to the boom arm 22 and bucket 24 by a linkage means identical to that just described.

Increased operator visibility is achieved by positioning the lift cylinders inwardly of the boom arms and by positioning the bucket cylinders outwardly of the boom arms. By positioning the bucket cylinders outside of the boom arms, greater power lever action is achieved which reduces strain on the bucket cylinder in the break-out action of the loader. The linkage connecting the bucket cylinders with the bucket transfers the strain from the bucket cylinder to the pivot pins. The arrangement of the linkage described herein results in greater break-out force or roll-back power in the work position. Inasmuch as the lift bucket cylinders are not positioned under the loader arms, this permits the bucket to be positioned closer to the front wheels on four-wheel tractors with steerable front wheels. The shorter couple loader device described herein results in exceptional high reach with short boom or loader arms. Inasmuch as the bucket cylinders are not positioned over the loader arms, greater roll-back and dumping positions are possible.

Figure 5:
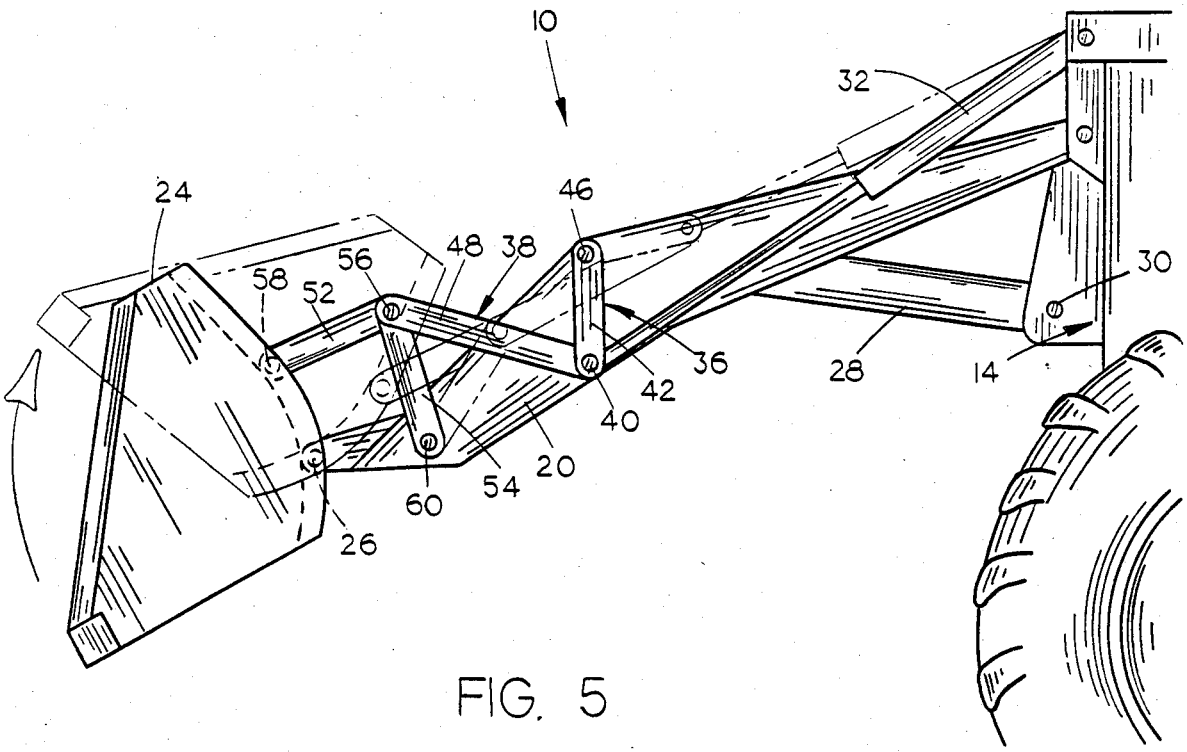
FIG. 5 is a side view of the device with the broken lines illustrating the roll-back position of the loader bucket.

An important feature of this invention is that the bucket cylinder linkage pivots about a stationary pivot point (pivot pins 46) so that the bucket load is transferred to the stationary pin which relieves the strain on the bucket cylinders in the loaded position. As illustrated by the broken lines in FIG. 5, the weight of the loaded bucket is pulling against pin 46 rather than on the bucket cylinder.

Thus it can be seen that the loader device of this invention accomplishes at least all of its stated objectives.

We claim:

1. A loader device for a tractor or the like, comprising, a frame means adapted to be secured to the tractor, said frame means including first and second, spaced-apart uprights having upper and lower ends, first and second boom arms, having rearward and forward ends and inner and outer sides, secured at their rearward ends to said first and second uprights respectively below the upper ends thereof, first and second hydraulic cylinders pivotally secured at one end to said first and second uprights respectively adjacent the lower ends thereof, and pivotally secured at their other ends to the inner sides of said first and second boom arms respectively intermediate the ends thereof, a loader bucket pivotally secured to the forward ends of said boom arms and being movable between a dumping position and a tipped-back position, third and fourth hydraulic cylinders pivotally connected at one end to said first and second uprights respectively adjacent the upper ends thereof and extending forwardly therefrom, and first and second linkage means pivotally connecting said third and fourth hydraulic cylinders to said loader bucket for moving said loader bucket between its said dumping position and tipped-back position, said first linkage means comprising a first pivot pin secured to said first boom arm intermediate the ends thereof and extending horizontally outwardly therefrom, a first link means, having opposite ends, pivotally secured at one end to said first pivot pin, a second link means, having opposite ends, pivotally secured at one end to the other end of said first link means, said other end of said third hydraulic cylinder being pivotally connected to the pivotal connection of said first and second link means, a third link means, having opposite ends, pivotally secured at one end to the other end of said second link means and pivotally secured at its other end to said loader bucket above and outwardly of the pivotal connection of said first boom arm and said loader bucket, a second pivot pin secured to said first boom arm rearwardly of but adjacent the forward end thereof and extending horizontally outwardly therefrom, a fourth link means, having opposite ends, pivotally secured at one end to the pivotal connection of said second and third link means and pivotally connected at its other end to said second pivot pin, said second linkage means being identical to said first linkage means but being positioned outwardly of the outer side of said second boom arm.

2. The loader device of claim 1 wherein said first link means comprises a pair of spaced-apart link members.

3. The loader device of claim 2 wherein said second link means comprises a pair of spaced-apart link members.

4. The loader device of claim 1 wherein the upper ends of said uprights are positioned laterally outwardly of the lower ends thereof to enable said third and fourth hydraulic cylinders to be positioned outwardly of said first and second boom arms respectively.

5. The loader device of claim 4 wherein said first and second hydraulic cylinders are positioned inwardly of the inner sides of said first and second boom arms respectively.

* * * * *